US008294350B2

(12) United States Patent
Freudenberger et al.

(10) Patent No.: US 8,294,350 B2
(45) Date of Patent: Oct. 23, 2012

(54) CATHODE

(75) Inventors: Joerg Freudenberger, Kalchreuth (DE); Wolfgang Kutschera, Aurachtal (DE); Gunter Roehrich, Erlangen (DE); Karin Soeldner, Schwaig (DE)

(73) Assignee: Siemens Aktiengesellschaft, Munich (DE)

( * ) Notice: Subject to any disclaimer, the term of this patent is extended or adjusted under 35 U.S.C. 154(b) by 462 days.

(21) Appl. No.: 12/557,706

(22) Filed: Sep. 11, 2009

(65) Prior Publication Data

US 2010/0067663 A1 Mar. 18, 2010

(30) Foreign Application Priority Data

Sep. 11, 2008 (DE) ..... 10 2008 046 721

(51) Int. Cl.
*H01J 1/15* (2006.01)

(52) U.S. Cl. ..... 313/341; 378/176

(58) Field of Classification Search ..... 313/341, 313/345, 346; 378/136
See application file for complete search history.

(56) References Cited

U.S. PATENT DOCUMENTS

| | | | | |
|---|---|---|---|---|
| 5,633,507 | A * | 5/1997 | Pfeiffer et al. | 250/492.23 |
| 5,742,662 | A | 4/1998 | Kuhn et al. | |
| 6,259,193 | B1 * | 7/2001 | Lipkin et al. | 313/341 |
| 6,480,572 | B2 | 11/2002 | Harris et al. | |
| 7,085,351 | B2 | 8/2006 | Lu et al. | |
| 7,512,215 | B2 * | 3/2009 | Morton et al. | 378/136 |
| 2004/0036398 | A1 | 2/2004 | Jin | |
| 2009/0103683 | A1 | 4/2009 | Hauttmann et al. | |

FOREIGN PATENT DOCUMENTS

| | | | |
|---|---|---|---|
| DE | 27 27 907 | A1 | 1/1979 |
| DE | 199 14 739 | C1 | 8/2000 |

* cited by examiner

*Primary Examiner* — Nimeshkumar Patel
*Assistant Examiner* — Mary Ellen Bowman
(74) *Attorney, Agent, or Firm* — Schiff Hardin LLP

(57) ABSTRACT

A cathode HAS a cathode head in which a surface emitter is arranged that emits electrons upon application of a heating voltage. The surface emitter is fashioned as a parallel surface emitter with at least two emitter surfaces spaced apart from one another, to which at least one electrically conductive cutoff electrode is fed that is galvanically separated from the parallel surface emitter. Such a cathode has a good cutoff capability.

11 Claims, 3 Drawing Sheets

CATHODE

BACKGROUND OF THE INVENTION

1. Field of the Invention

The present invention concerns a cathode of the type having a cathode head in which a surface emitter is arranged that emits electrons upon application of a heating voltage thereto.

2. Description of the Prior Art

A cathode of the above type in which the surface emitter has a rectangular footprint is known from DE 27 27 907 C2, for example. A surface emitter with a circular footprint is described in DE 199 14 739 C1. In the known surface emitters, a heating voltage is applied to the surface emitter during the operation of the x-ray tube, whereby electrons are emitted that are accelerated in the direction of an anode. X-ray radiation is generated in the surface of the anode upon impact of the electrons at the anode.

Such a surface emitter has a distinctly larger radiant surface usable for emission relative to the volume to be heated and in comparison to a filament emitter. The surface emitter therefore can be operated with a reduced working temperature relative to a filament emitter, so the service life of the cathode is increased.

The longer service life of a surface emitter due to the larger radiant surface (emission surface) requires a greater effort for cutoff of the emitted electron beam.

This beam cutoff by application of a negative voltage to the cathode head is necessary in many applications, in particular in applications with pulsed x-ray radiation. The more central regions of large-area surface emitters are geometrically farther removed from the electron accumulations generating the cutoff field at the cathode head, and thus can only be cut off by higher electron concentrations or higher field strengths. Higher field strengths, in turn, require larger minimum distances to be maintained to avoid arcing, as well as additional design costs.

SUMMARY OF THE INVENTION

An object of the present invention is to provide a cathode with a good cutoff capability.

The above object is achieved by a cathode according to the invention that has a cathode head in which a surface emitter is arranged that emits electrons upon application of a heating voltage, wherein the surface emitter is fashioned as a parallel surface emitter with at least two emitter surfaces spaced apart from one another, to which at least one electrically conductive cutoff electrode is fed that is galvanically separated from the parallel surface emitter. The emitter surfaces spaced apart from one another thus form partial emitters in the cathode according to the invention.

Multiple partial emitters connected in parallel, each partial emitter having a width of approximately 1 mm to 2 mm and being able to be grid-extinguished given a low cutoff voltage, are produced by the division of the surface emitter into at least two emitter surfaces as described above.

By fashioning the surface emitter as a parallel surface emitter with at least two emitter surfaces spaced apart from one another, and by feeding at least one electrically conductive cutoff electrode (that is galvanically separated from the surface emitter) to the surface emitter, the disadvantage of a poorer cutoff capability, or a cutoff capability that can only be achieved with a higher cutoff voltage, is remedied. The cathode according to the invention thus can be used for applications in which a fast cutoff capability of the electron emission is required. In spite of the fast cutoff capability, the cathode according to the invention also exhibits a long service life.

Higher field strengths for fast cutoff of the surface emitter that require greater minimum distances to be maintained to avoid arcing (as well as additional design measures) are thus not necessary in the cathode according to the invention.

In an embodiment of the invention, the cutoff electrode can lie at a cathode head potential, but this does not necessarily have to be the case. It is also possible for the cutoff electrode to be galvanically separated both from the surface emitter and from the cathode head, and thus at a different potential than the cathode head.

Depending on the design requirements or limit conditions for the cathode, the cutoff electrode can be fashioned as a barrier plate or as a barrier grid, in which case the cutoff electrode advantageously has a wire structure.

For example, a wire structure can be generated by wires that are soldered onto an insulator (for example ceramic) or are deposited on the substrate in a screening method.

If the cutoff electrode is executed as a barrier grid, at least one wire can be introduced between two adjacent emitter surfaces (for example given a surface emitter with rectangular emitter surfaces). It is also possible to span wires across the surface emitter, but this leads to a significant distortion of the electron beam and may, under the circumstances, entirely prevent the electron emission of the surface emitter. This can be avoided if the wires of the barrier grid are at a potential between the cathode potential and the anode potential (intermediate potential). Such an intermediate potential is naturally also possible for a cutoff electrode that is executed differently, for example a wire-like structure or barrier plate. The cutoff electrode need only be arranged so as to be electrically insulated from the cathode head and electrically insulated from the emitter surfaces.

In a further embodiment of the cathode according to the invention, the emitter surfaces of the parallel surface emitter are fashioned as a common component. For example, structures are cut from a plate with a laser to produce the parallel surface emitter. The parallel surface emitter produced in this way possesses at least two separate emitter surfaces (partial emitters) and—independent of the number of emitter surfaces—two small terminal legs. Such a surface emitter can be worked with just as simply as known emitters in terms of production and can be integrated into a cathode head.

However, for specific application cases it can also be advantageous for the emitter surfaces of a parallel surface emitter to be fashioned as separate components. In this case each emitter surface (partial emitter) has two small terminal legs so that the emitter surfaces can be activated separately.

DESCRIPTION OF THE PREFERRED EMBODIMENTS

Figure 1:
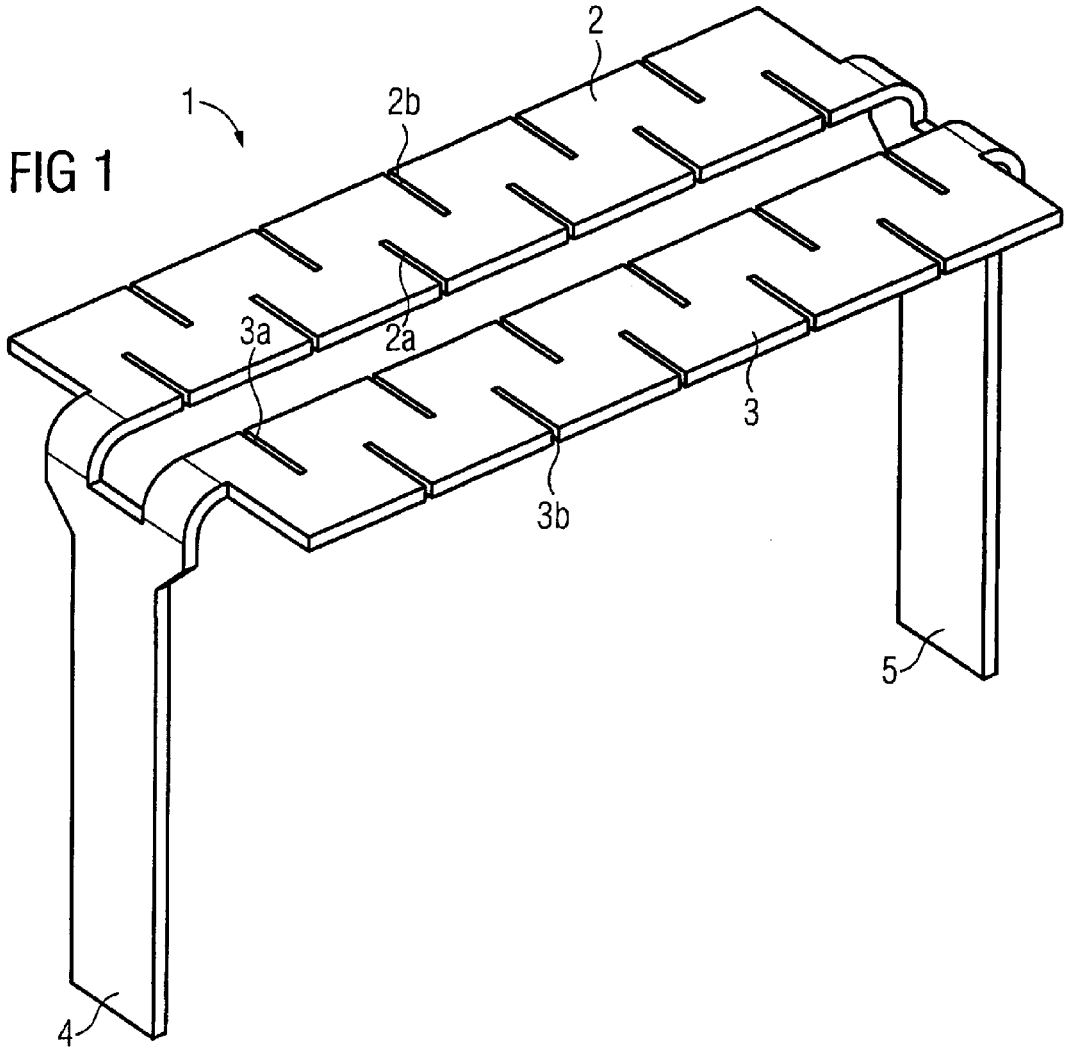
FIG. 1 is a perspective view of a parallel surface emitter in an embodiment of a cathode according to the invention.

A parallel surface emitter that has two emitter surfaces 2 and 3 (partial emitters) separated from one another and possesses two small terminal legs or lugs 4 and 5 at its ends is designated with 1 in FIG. 1. The emitter surfaces 2 and 3 are executed as rectangles and consist of, for example, a plate of tungsten 0.05 mm thick with a side length of 1.45 mm by 10 mm. The emitter surfaces 2 and 3 respectively have incisions 2*a*, 2*b*, 3*a* and 3*b* that are arranged in alternation from two opposite sides and transversal to the longitudinal direction.

The emitter surfaces 2 and 3 are fashioned as a common component so that the emitter surfaces 2 and 3 thus lie at the same potential and thermionically emit electrons upon application of a heating voltage at the small terminal legs 4 and 5.

The surface emitter 1 can be processed just as simply as known surface emitters in terms of production. For example, the structures of the emitter surfaces 2 and 3 can be cut from a plate and be provided with incisions 2*a*, 2*b*, 3*a* and 3*b* with a laser.

Figure 2:
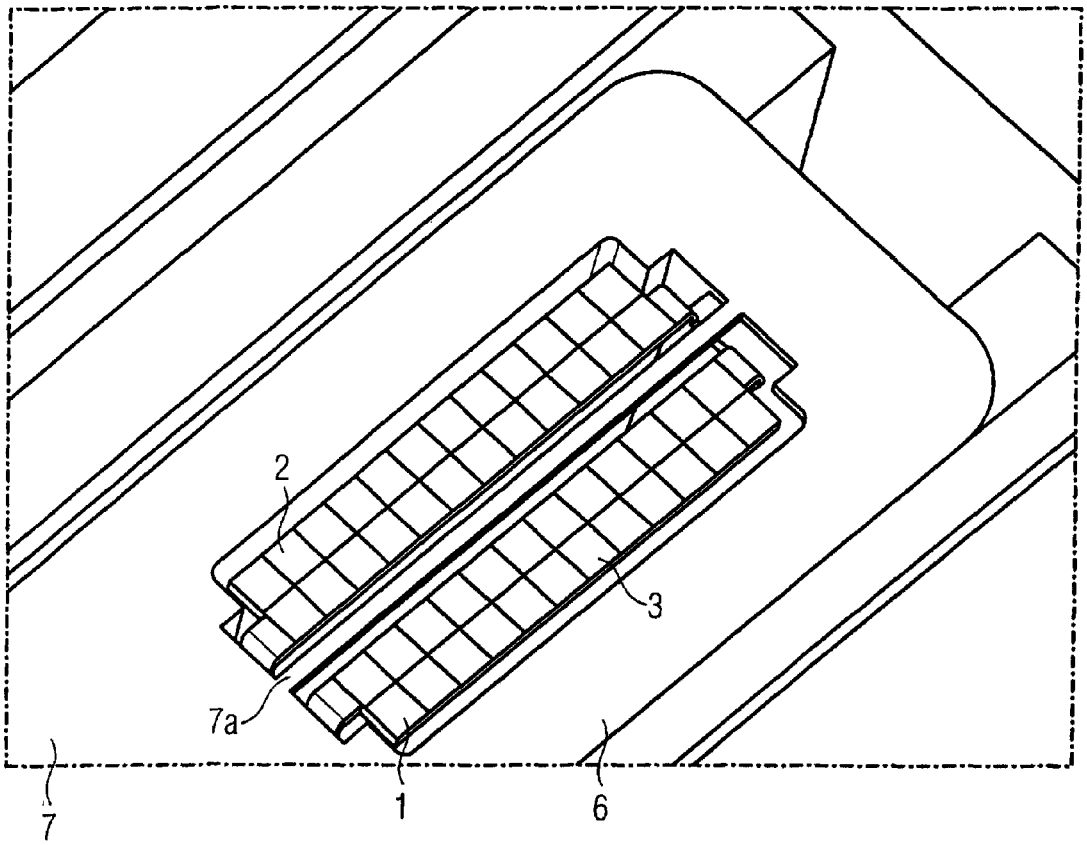
FIG. 2 is a perspective view of a cathode head with an integrated parallel surface emitter according to FIG. 1.

The surface emitter 1 can be integrated into a cathode head 6, as is shown in FIG. 2, for example. Due to its dimensions (width, length and shape of the small terminal legs as in a known surface emitter), the surface emitter 1 can replace a known surface emitter without any problems.

In the cathode head 6 shown in FIG. 2, a screen (that is not visible in FIG. 2 due to the perspective depiction) is placed over the surface emitter 1 such that an electrically insulated cutoff electrode 7 comes to lie between the two adjacent emitter surfaces 2 and 3. The cutoff electrode in the shown exemplary embodiment possesses a wire-like structure that comprises a flat wire 7*a* running between the two emitter surfaces 2 and 3.

The blocking voltage can be applied to the cathode head 6 (for example) when this has electrical contact with the cutoff electrode 7. In the event that the cutoff electrode 7 is arranged so as to be electrically insulated from the cathode head 6, the cutoff voltage is then directly applied to the cutoff electrode 7.

Figure 3:
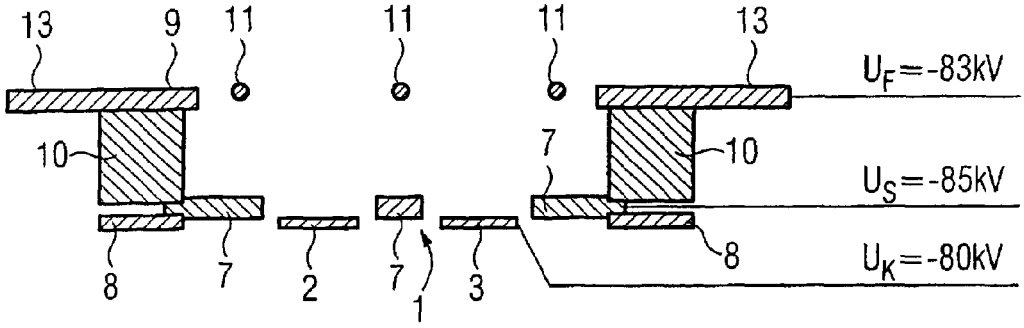
FIG. 3 is a schematic representation of a cathode head in cross section.

The cathode shown in the blocked state in FIG. 3 comprises a cathode head 6 in which is arranged a parallel surface emitter 1 that thermionically emits electrons (not shown in FIG. 3) upon application of a heating voltage, which electrons are accelerated in the direction of an anode (not shown in FIG. 3) that is at an anode potential of $U_A$=+80 kV, for example.

The parallel surface emitter 1 is at a cathode potential $U_K$ of −80 kV, for example.

The parallel surface emitter 1 in the shown exemplary embodiment possesses two emitter surfaces 2 and 3 separated from one another.

An electrically conductive cutoff electrode 7 that is galvanically separated from the parallel surface emitter 1 by an insulator arrangement 8 (for example $Al_2O_3$) is fed to the surface emitters 2 and 3. In the shown embodiment, the cutoff electrode 7 has a wire-like structure.

The cutoff electrode 7 can be connected to a cutoff voltage $U_S$ that is more negative than the cathode potential $U_K$=−80 kV. If the cutoff electrode 7 is connected to the cutoff voltage $U_S$, an exit of the negatively charged electrons from the cathode head 6 is reliably prevented. In the shown exemplary embodiment, $U_S$=−85 kV.

If the cutoff voltage is disconnected ($U_S$=$U_K$+0 kV, thus $U_S$=−80 kV), the electrons can then flow through the cutoff electrode 7 in the direction of the anode. The cutoff electrode 7 can thus be connected between two potential levels, namely—80 kV and −85 kV.

Figure 4:
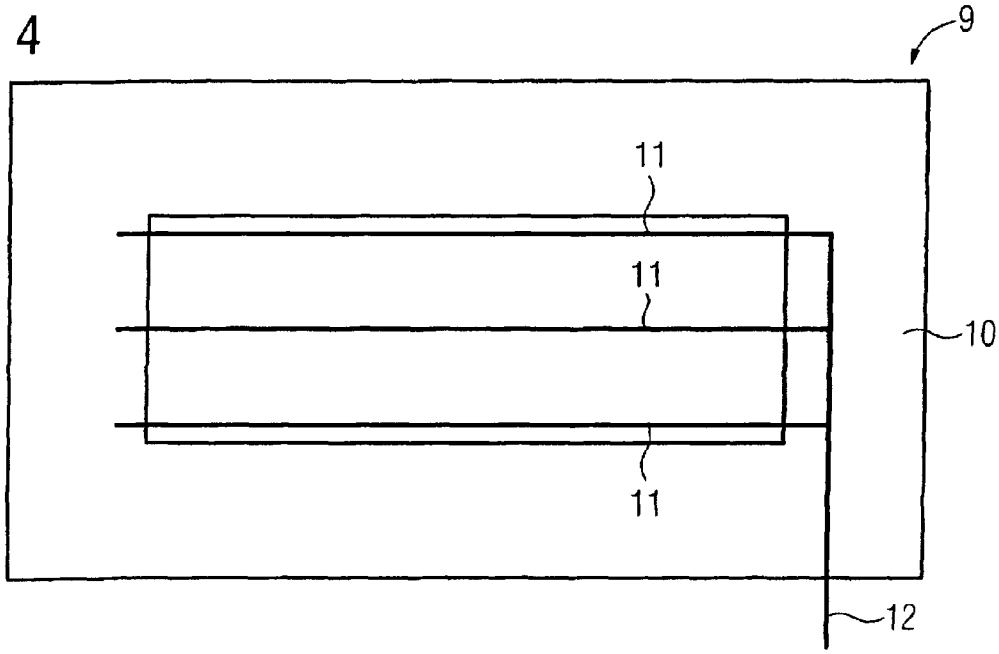
FIG. 4 is a schematic representation of an electron focusing element for a parallel surface emitter.

As an optional embodiment, the cathode head 6 shown in FIG. 3 has an electron focusing element 9 galvanically separated from the cathode head 6, this electron focusing element 9 being schematically shown in FIG. 4.

The electron focusing element 9 has an insulating frame 10 on which focusing wires 11 are arranged that can be connected via a connection wire 12 to a focusing voltage $U_F$ of (for example) −83 kV. The focusing wires 11 are arranged in a plate frame 13 in a simple manner (in terms of production).

In that the focusing voltage ($U_F$=−83 kV) is more positive by 2 kV than the cutoff voltage ($U_S$=−85 kV) and more negative by 3 kV than the cathode potential ($U_K$=−80 kV), the electrons are focused upon application of the focusing voltage.

If the cutoff electrode 7 is connected to the cutoff voltage $U_S$=−85 kV, the electron focusing element 9 is simultaneously connected to −80 kV. The electron focusing element 9 therefore does not affect the cutoff effect of the cutoff electrode 7.

The focusing voltage $U_F$ can thus be switched between two potential levels, namely −83 kV and −80 kV (cathode potential $U_K$).

The aforementioned voltage values to be understood merely as examples. Other voltage values can also be realized without difficulty by those skilled in the art.

In the embodiment of the cathode according to the invention as presented in FIG. 3, the cutoff electrode 7 therefore comes very close to the more central regions of the emitter surfaces 2 and 3 of the parallel surface emitter 1. Higher field strengths for fast cutoff of the parallel surface emitter 1 that require greater minimum distances to be maintained to avoid flashovers, as well as further additional design measures, are therefore not necessary given a cathode with a parallel surface emitter according to FIG. 3.

A cathode according to FIG. 3 is thus particularly well suited for applications in which a fast cutoff capability of the electron emission comparable with a filament emitter is desired or, respectively, required (for example in applications with pulsed x-ray radiation), and at the same time a longer service life of the parallel surface emitter 1 (and therefore of the cathode) is achieved.

Although modifications and changes may be suggested by those skilled in the art, it is the intention of the inventors to embody within the patent warranted hereon all changes and modifications as reasonably and properly come within the scope of their contribution to the art.

We claim as our invention:

1. A cathode comprising:

a cathode head in which a surface emitter is arranged that emits electrons upon application of a heating voltage thereto;

said surface emitter being formed as a parallel surface emitter with at least two emitter surfaces that are spaced apart from one another with an open space therebetween; and at least one electrically conductive cutoff electrode that is located in said open space between said emitter surfaces and is galvanically separated from the parallel surface emitter.

2. A cathode according to claim 1, wherein cutoff electrode is at a potential of the cathode head.

3. A cathode according to claim 1, wherein the cutoff electrode is galvanically separated from the cathode head.

4. A cathode according to claim 1, wherein the cutoff electrode is formed as a barrier plate.

5. A cathode according to claim 1, wherein the cutoff electrode is formed as a barrier grid.

6. A cathode according to claim 5, wherein the cutoff electrode has a wire structure.

7. A cathode according to claim 1, wherein the emitter surfaces of the parallel surface emitter are formed as a common unitary component.

8. A cathode according to claim 1, wherein the emitter surfaces of the parallel surface emitter are formed as separate components.

9. A cathode as claimed in claim 1 wherein each of said at least two emitter surfaces is configured to emit electrons at an energy sufficient to produce x-rays upon striking an anode composed of material capable of emitting x-rays.

10. A cathode as claimed in claim 1 wherein said parallel emitter surface is configured to operate at a potential of −80 kV with respect to an anode potential of +80 kV, and wherein said cutoff electrode is configured to operate at a cutoff voltage that is more negative than said cathode potential.

11. A cathode as claimed in claim 10 wherein said cutoff electrode is configured to operate at a cutoff voltage of −85 kV.

* * * * *